US011338951B1

(12) United States Patent
Hinkle

(10) Patent No.: US 11,338,951 B1
(45) Date of Patent: May 24, 2022

(54) BAG HOLDER CLAMP AND METHOD

(71) Applicant: Billy Don Hinkle, Moro, AR (US)

(72) Inventor: Billy Don Hinkle, Moro, AR (US)

( * ) Notice: Subject to any disclaimer, the term of this patent is extended or adjusted under 35 U.S.C. 154(b) by 0 days.

(21) Appl. No.: 17/022,710

(22) Filed: Sep. 16, 2020

Related U.S. Application Data

(63) Continuation-in-part of application No. 16/595,098, filed on Oct. 7, 2019, now abandoned, which is a continuation-in-part of application No. 15/974,381, filed on May 8, 2018, now abandoned, which is a continuation-in-part of application No. 14/697,014, filed on Apr. 27, 2015, now abandoned, which is a continuation-in-part of application No. 14/246,840, filed on Apr. 7, 2014, now abandoned, and a continuation-in-part of application No. 29/487,247, filed on Apr. 7, 2014, now Pat. No. Des. 779,315.

(51) Int. Cl.
*B65B 67/12* (2006.01)
*A45F 5/02* (2006.01)

(52) U.S. Cl.
CPC ..... *B65B 67/1233* (2013.01); *A45F 5/021* (2013.01)

(58) Field of Classification Search
CPC ..... B65F 1/1415; B65B 67/1233
USPC ..... 248/99, 101
See application file for complete search history.

(56) References Cited

U.S. PATENT DOCUMENTS

| | | | | |
|---|---|---|---|---|
| 397,346 | A | 2/1889 | Ellis | |
| 1,461,802 | A | 7/1923 | McRoberts | |
| 1,695,822 | A | 12/1928 | Restein | |
| 1,751,229 | A | 3/1930 | Bigelow | |
| 2,245,037 | A | 6/1941 | Hersey, Jr. | 285/71 |
| 2,462,973 | A | 3/1949 | Kelrick | 248/101 |
| 2,775,806 | A | 1/1957 | Love | 24/271 |
| D208,388 | S | 8/1967 | Graham | 91/3 |
| 3,893,699 | A | 7/1975 | Morris | 280/34 |
| 4,411,300 | A | 10/1983 | Rico | 150/51 |
| 4,465,330 | A | 8/1984 | De Cenzo | 339/14 |
| 4,550,440 | A | 10/1985 | Rico | 383/33 |
| 4,768,742 | A | 9/1988 | Kaaloa | 248/99 |
| 4,773,585 | A | 9/1988 | Lehrman | 232/1 |
| 4,934,637 | A | 6/1990 | Guerrera | 248/100 |
| 4,972,982 | A | 11/1990 | Harbour | 224/270 |
| 5,125,605 | A | 6/1992 | Guerrera | 248/100 |
| 5,366,263 | A | 11/1994 | Hendrickson | 285/364 |
| 5,380,052 | A | 1/1995 | Hendrickson | 285/364 |
| 5,540,465 | A | 7/1996 | Sisk | 285/365 |
| 5,620,210 | A | 4/1997 | Eyster et al. | 285/81 |
| 5,641,138 | A | 6/1997 | Cronk et al. | 248/99 |
| D386,246 | S | 11/1997 | Sonden et al. | 23/262 |
| 5,711,563 | A | 1/1998 | Sapp | 294/1.1 |
| 5,722,666 | A | 3/1998 | Sisk | 277/101 |
| 5,915,606 | A | 6/1999 | Jensen | 224/148.6 |
| 6,086,022 | A | 7/2000 | Dalton | 248/99 |
| 6,170,883 | B1 | 1/2001 | Mattsson et al. | 285/110 |
| 6,202,709 | B1 | 3/2001 | Wymer | 141/10 |

(Continued)

*Primary Examiner* — Bradley Duckworth

(74) *Attorney, Agent, or Firm* — Keisling & Pieper PLC; David B. Pieper; Trent C. Keisling

(57) ABSTRACT

A bag carrying clamp and method are described using an inner ring providing shape support to a flexible plastic forming the bag to provide a compression surface against which an outer split ring with segmented pressure fingers can be compressed using an overcenter clamp. Strap and belt connections for carrying the ring and the attached bag are also provided.

3 Claims, 14 Drawing Sheets

(56) References Cited

U.S. PATENT DOCUMENTS

| | | | | |
|---|---|---|---|---|
| 6,425,608 | B1 | 7/2002 | Nordstrom | 285/374 |
| 6,604,717 | B2 | 8/2003 | Stanfield | 248/99 |
| 6,637,938 | B2 | 10/2003 | Watkins | 383/23 |
| 6,679,462 | B1 | 1/2004 | Valdez | 248/99 |
| 6,691,959 | B1 | 2/2004 | Dancy | 248/100 |
| D504,503 | S | 4/2005 | Thurman | 23/393 |
| 7,004,511 | B2 | 2/2006 | Barron et al. | 285/342 |
| D614,271 | S | 4/2010 | Weston | 23/269 |
| 7,703,723 | B1 | 4/2010 | Cooper et al. | 248/97 |
| D625,783 | S | 10/2010 | Madara | 23/262 |
| D629,496 | S | 12/2010 | Madara et al. | 23/262 |
| D654,785 | S | 2/2012 | Clorley | 8/396 |
| D703,032 | S | 4/2014 | Bigdeliazari | 8/396 |
| D703,033 | S | 4/2014 | Karlsson | 8/396 |
| 8,720,955 | B2 | 5/2014 | Untch | 285/365 |
| 8,770,454 | B1 | 7/2014 | Lutz | 224/625 |
| D715,412 | S | 10/2014 | Sgherri | 23/269 |
| D723,362 | S | 3/2015 | Bacon | 8/396 |
| D728,757 | S | 5/2015 | Graham | 23/269 |
| 9,028,146 | B2 | 5/2015 | Brimson | 220/315 |
| D737,133 | S | 8/2015 | Sandman et al. | 8/396 |
| 9,551,505 | B2 * | 1/2017 | Sandman | F24F 13/10 |
| D779,315 | S | 2/2017 | Hinkle | 8/396 |
| 2003/0197381 | A1 | 10/2003 | Lehnhardt | 285/364 |
| 2004/0222333 | A1 | 11/2004 | Quick | 248/99 |
| 2005/0023824 | A1 | 2/2005 | Breay et al. | 285/1 |
| 2006/0097524 | A1 | 5/2006 | Stolzman | 292/256.69 |
| 2006/0220395 | A1 | 10/2006 | Kuzelka | 292/256.69 |
| 2009/0230258 | A1 | 9/2009 | McFadden | 248/101 |
| 2009/0294449 | A1 | 12/2009 | Taylor | 220/321 |
| 2010/0038902 | A1 | 2/2010 | Sandman et al. | 285/337 |
| 2010/0117360 | A1 | 5/2010 | Chan | 285/373 |
| 2010/0140423 | A1 | 6/2010 | Davies et al. | 248/101 |
| 2011/0147545 | A1 | 6/2011 | Faraone | 248/99 |
| 2012/0091174 | A1 | 4/2012 | Breeze | 224/222 |
| 2012/0224947 | A1 | 9/2012 | Fitzpatrick et al. | 414/808 |
| 2014/0150397 | A1 | 6/2014 | Palmer | 56/400.11 |
| 2015/0285419 | A1 | 10/2015 | Hinkle | |

* cited by examiner

BAG HOLDER CLAMP AND METHOD

CROSS-REFERENCE TO RELATED APPLICATIONS

This application claims priority to is a continuation-in-part of U.S. patent application Ser. No. 16/595,098, filed Oct. 7, 2019 entitled BAG HOLDER CLAMP AND METHOD which is a continuation-in-part of U.S. patent application Ser. No. 15/974,381, filed May 8, 2018 entitled BAG HOLDER CLAMP AND METHOD which is a continuation-in-part of U.S. patent application Ser. No. 14/697,014, filed Apr. 27, 2015 entitled BAG HOLDER CLAMP AND METHOD which is a continuation-in-part of both 1) U.S. Design Patent Application Serial No. 29/487,247, filed on Apr. 7, 2014 entitled OUTER PIPE CLAMP RING; and
2) U.S. patent application Ser. No. 14/246,840, filed Apr. 7, 2014 entitled OVERCENTER PIPE CLAMP AND METHOD FOR LAY FLAT TUBING.

All of which are hereby incorporated by reference in their entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in a pipe clamp for a flexible lay flat tubing such as that used in row crop irrigation systems and the use of that clamp as a bag clamp and a bag carrier. More particularly, the invention relates to improvements particularly suited for applying appropriate pressure to the clamping area and frictionally engaging a sufficient amount of plastic without tearing or otherwise damaging the plastic tubing or bag.

2. Description of the Known Art

As will be appreciated by those skilled in the art, clamps are known in various forms to apply high amounts of pressure to pipe joints. However, it is not know how to quickly attach low pressure irrigation tubing without tearing or damaging the tubing or clamp and hold plastic bags with no damage or pull out of the plastic.

Poly lay flat flexible irrigation tubing 10 is a polyethylene tubing used with irrigating row crops in level grade farming sold under trade names like POLYPIPE or DURAPIPE.

Poly-Pipe lay-flat flexible tubing is a long, generally one thousand foot or more, seamless tube packaged flattened in convenient rolls which can be unwound from the back of a vehicle or manually. Poly-Pipe lay-flat flexible tubing is not designed to transfer water over hills or up grades. This is an extremely low cost temporary irrigation system for use in irrigating fields. Typically provided in diameters of 7, 9, 10, 12, 15, or 18 inches and a thickness of 7 or 10 mil. It is designed for high volume low pressure flows and is not designed for use in moving water uphill or over berms. Thus, unlike flexible pipes used on fire trucks, poly pipe is not designed for high pressure and is not provided with couplings or connectors because it has to be cut to length in the field. In typical applications, miles of pipe are laid in the spring and taken up and recycled each fall. Because the pipe is provided in short sections, hundreds, if not thousands of connections may have to be done each spring and then removed each fall.

Similarly, garbage bags are usually formed from low mil plastic with a sealed end.

Patents disclosing information relevant to pipe clamps include: U.S. Pat. No. 5,722,666, issued to Sisk on Mar. 3, 1998, entitled Pipe coupler gasket with triangular sealing ridges; U.S. Pat. No. 5,540,465, issued to Sisk on Jul. 30, 1996 entitled Pipe, valve and/or tee coupler; U.S. Pat. No. 5,380,052, issued to Hendrickson on Jan. 10, 1995 entitled Releasable handle-type fastener for pipe couplings; and U.S. Pat. No. 5,366,263, issued to Hendrickson on Nov. 22, 1994 entitled Releasable fastener for pipe couplings. Each of these patents is hereby expressly incorporated by reference in their entirety. From these prior references it may be seen that these prior art patents are very limited in their teaching and utilization, and an improved over center pipe clamp is needed to overcome these limitations.

SUMMARY OF THE INVENTION

The present invention is directed to an improved over center pipe clamp using an inner ring, outer ring with extending arms and compression fingers, and an over center clamp. In accordance with one exemplary embodiment of the present invention, an over center pipe clamp is provided using a clamping segments and spacing segments to provide high gripping force sufficient for use with thin wall tubing while providing a low pressure sealing force in a quick installation and quick removal pipe clamp. A method for installing the splice is taught so that the interior of the pipe flow is not impeded with flapping or exposed end sections.

Still further, the present invention is directed to using that over center clamp and ring system for holding a garbage bag on a user utilizing a belt and strap system. The use of rising neck P shaped connections and belt loop in combination with the law pressure non tearing inner ring and outer ring clamp system allow for carrying a garbage bag with no tearing. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
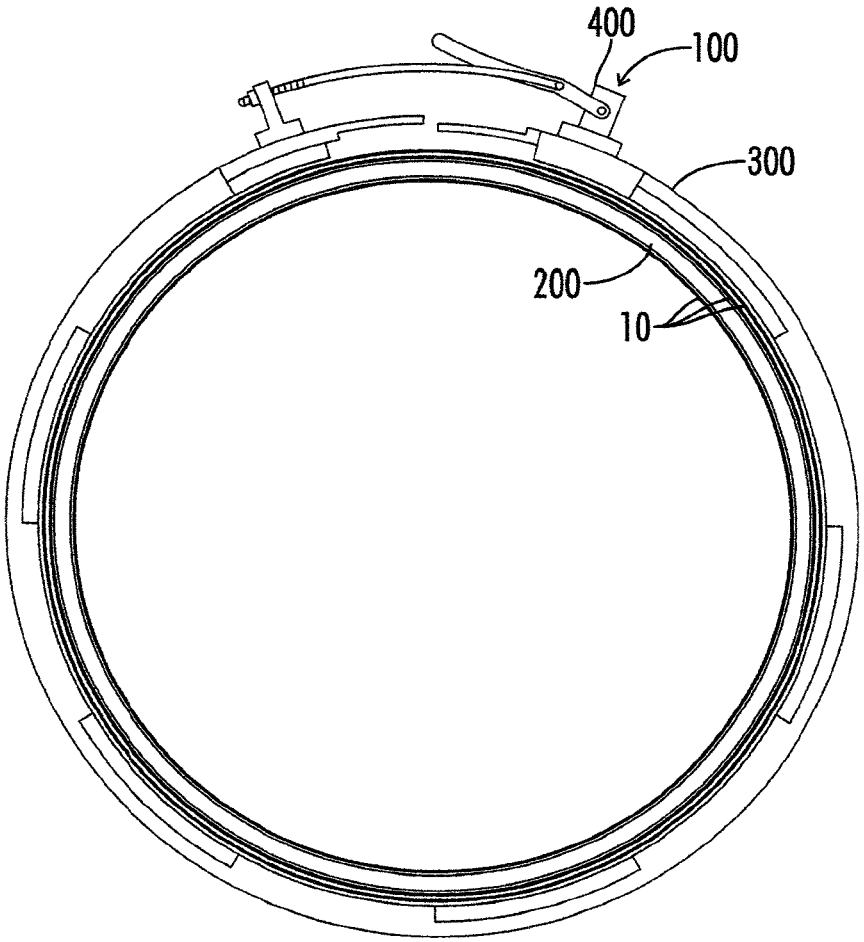
FIG. 1 is a schematic front view of the overcenter pipe clamp with extending compression fingers of the present invention.
Figure 2:
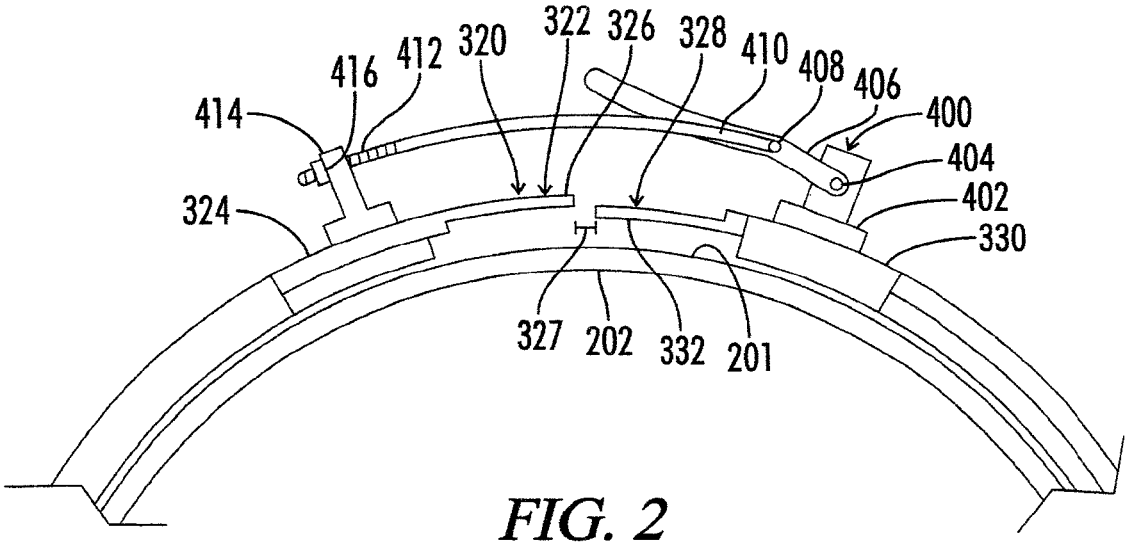
FIG. 2 is a larger view of the overcenter pipe clamp of FIG. 1 showing an open position.
Figure 3:
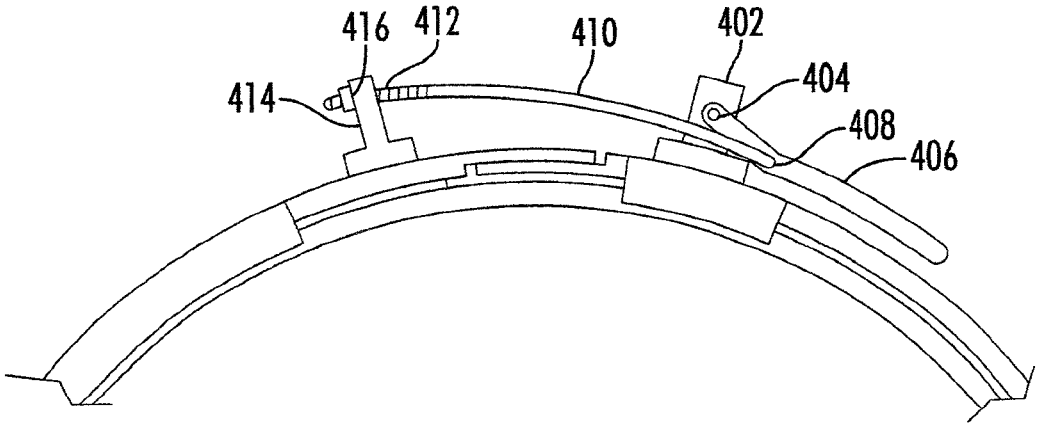
FIG. 3 is a larger view of the overcenter pipe clamp of FIG. 1 showing a closed position.
Figure 4:
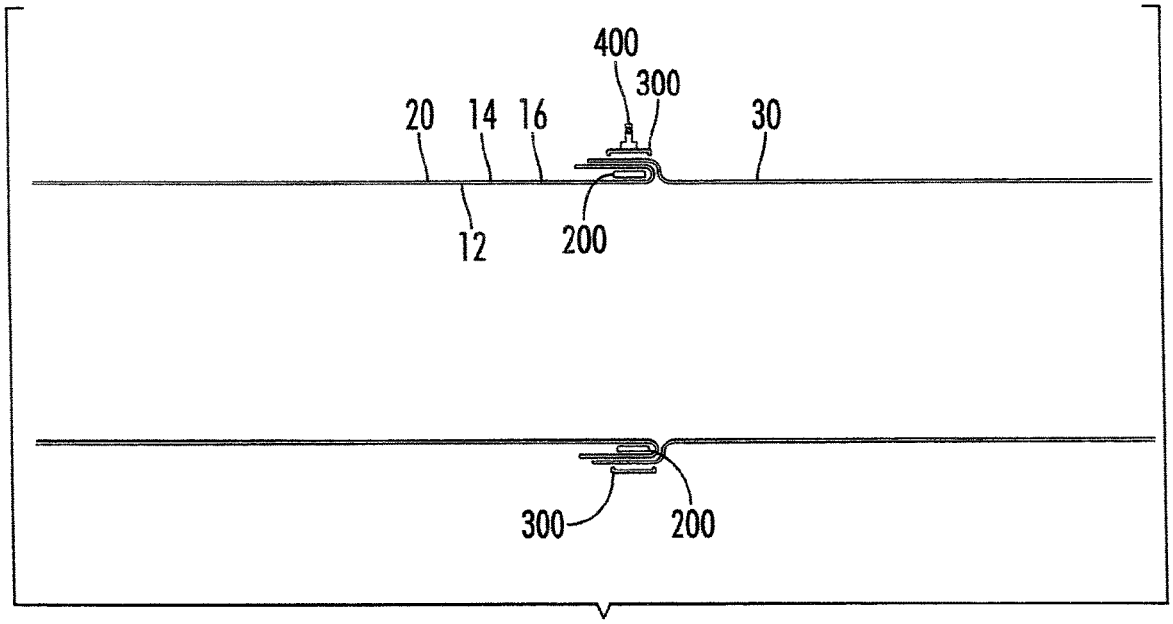
FIG. 4 is a cutaway view of the overcenter pipe clamp of FIG. 1 showing the first and second pipe ends with the clamp in an open position.
Figure 5:
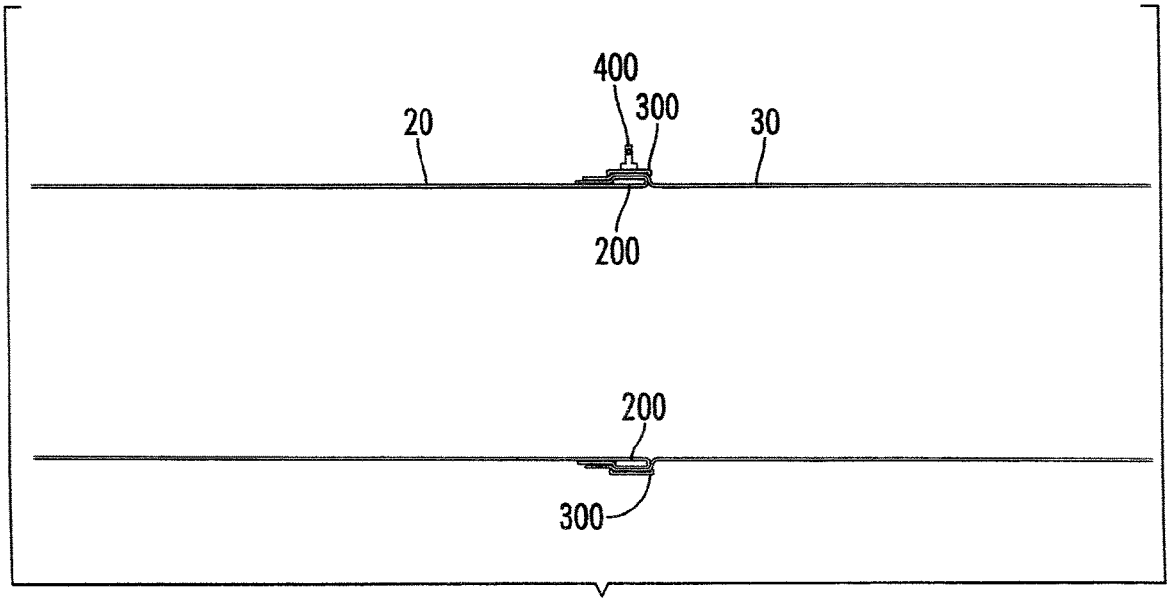
FIG. 5 is a side cutaway view of the overcenter pipe clamp of FIG. 1 showing the first and second pipe ends with the clamp in a closed position.

As shown in FIGS. 1 through 7 of the drawings, one exemplary embodiment of the present invention is generally shown as a flexible plastic tube quick clamp 100 for poly lay flat flexible irrigation tubing 10. FIGS. 1, 4, 5, 6, and 7 show the poly lay flat flexible irrigation tubing 10 with a pipe inner surface 12, non-structural collapsing pipe wall 14 with a cracking or minimum bend 15, and a pipe outer surface 16. The minimum bend 15 is the sharpest radius that may be used without cutting or tearing the tubing 10. A first tubing end 20 and second tubing end 30 are shown for clamping.

As shown in FIGS. 1 through 7 of the drawings the flexible plastic tube quick clamp 100 is constructed from an inner shape ring 200, an outer split ring 300, and an overcenter clamp 400.

The inner shape ring 200 includes an inner surface 202 between a left folding edge 204 and a right folding edge 206 so that either direction of flow may be utilized in the tubing 10. Each folding edge 204, 206 has a minimum folding radius 208 greater than the minimum bend 15 of the tubing. The inner shape ring 200 also includes an outside clamping surface 210 that is used to contact the tubing 10 and compressably secure it in position. The outside clamping surface 210 defines width for the ring clamping surface 201. In this embodiment, the ring clamping surface 201 extends from the left folding edge 204 to the right folding edge 206.

The outer split ring 300 includes an inside clamping surface 302 that works with the outside clamping surface 210 of the inner ring 200 to compressably, sealably, and frictionally hold the tubing 10 in position. The outer split ring 300 includes a left capturing edge 304 and right capturing edge 306. Each capturing edge 304, 306 is shown with multiple capturing segments 308 alternating with multiple spacing segments 318 around the outer ring 300. Each capturing segment 308 includes an extending arm 310 reaching out an extending distance 311 to support a catch finger 312. Each catch finger is made with a finger depth 314 terminating at a finger tip 315 with a tip radius 316 greater than the minimum bend 15 of the tubing 10. If the left edge is provided with a capturing segment 308 then the preferred embodiment uses a spacing segment 318 on the right edge. These alternating sections and opposite alternating sides provide gripping while flexing alternating sides of the outer ring 300 to prove the downward force without harming the thin wall of the tubing 10. In this manner, only one half of the gripping force is applied on one side of the outer ring 300 such that the tubing is not exposed to a continuous or circular point load to stress the rubbing 10.

The outer ring 300 is split at an adjustable joint 320. The adjustable joint 320 includes a left ring end 322 with a left clamping surface 324 and a left sliding overlap finger 326 separated by a ring gap 327 to a right ring end 328 with a right clamping surface 330 and a right sliding overlap finger 332.

The adjustable joint is opened, closed, and secured by an overcenter clamp 400. The overcenter clamp is built off of a base handle riser 402 connected to the right ring end 328 by rivets, glue or the other securing method. The base handle riser 402 includes a handle pivot 404 that pivotally supports a layflat pipe clamp handle 406 that is positioned to be able to provide an over center clamping force to lock the handle in position. The handle 406 includes an arm pivot 408 connecting an extending catch arm 410 with a length adjuster 412 for engaging a catch slot 416 in a catch riser 414 secured to the left ring end 322.

Figure 6:
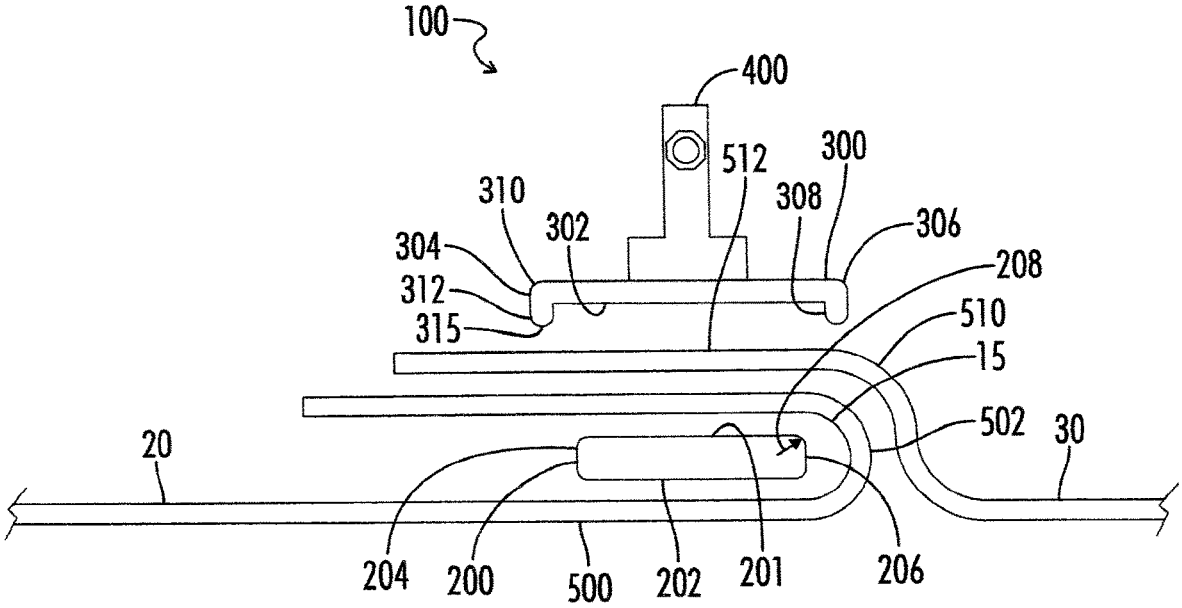
FIG. 6 is a larger side cutaway view of the first and second pipe ends with the clamp in an open position.
Figure 7:
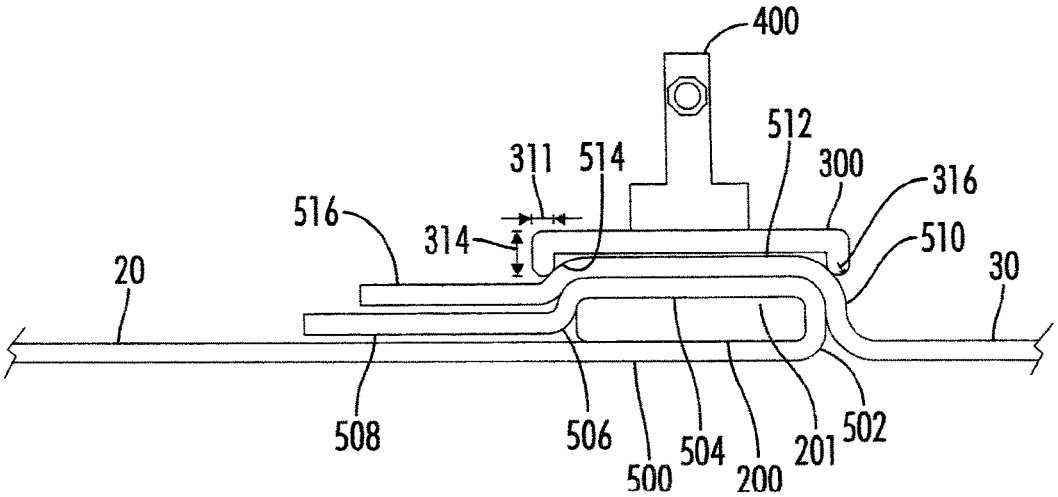
FIG. 7 is a larger side cutaway view of the first and second pipe ends with the clamp in a closed position.
Figure 8:
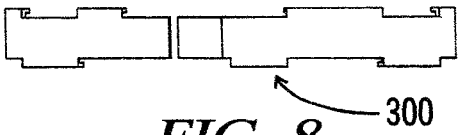
FIG. 8 is a top view of the outer ring.
Figure 9:
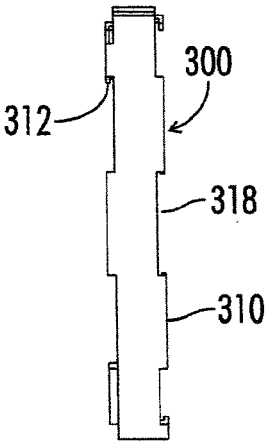
FIG. 9 is a left side view of the outer ring.
Figure 10:
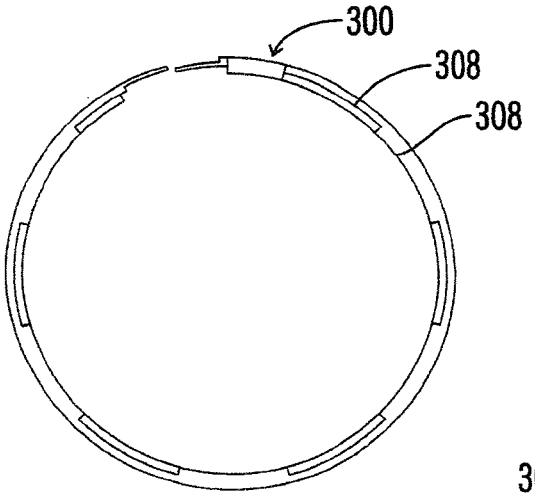
FIG. 10 is a front view of the outer ring.
Figure 11:
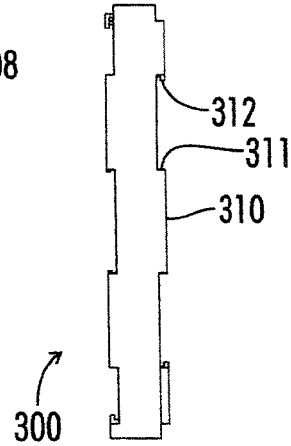
FIG. 11 is a right side view of the outer ring.
Figure 12:
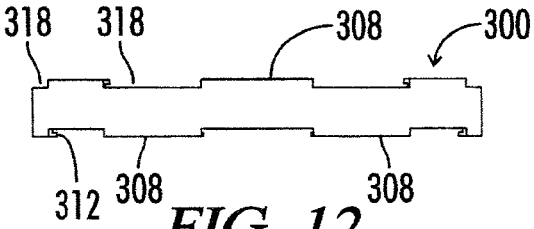
FIG. 12 is a bottom view of the outer ring.
Figure 13:
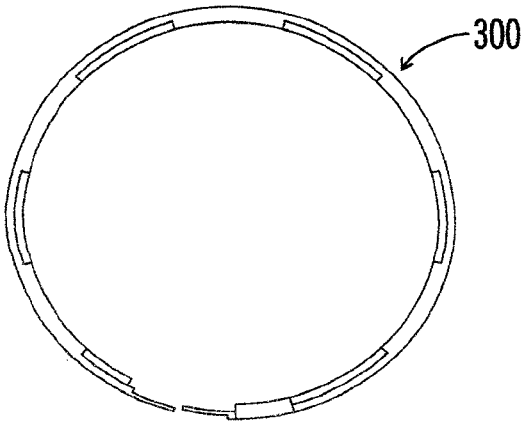
FIG. 13 is a back view of the outer ring.
Figure 14:
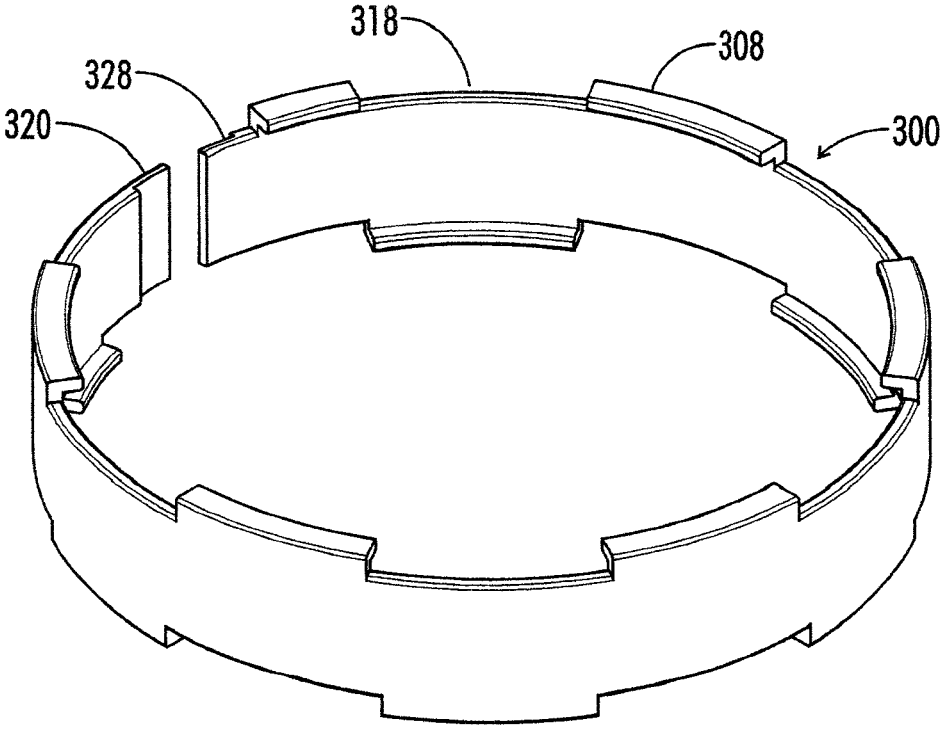
FIG. 14 is an isometric view of the outer ring.
Figure 15:
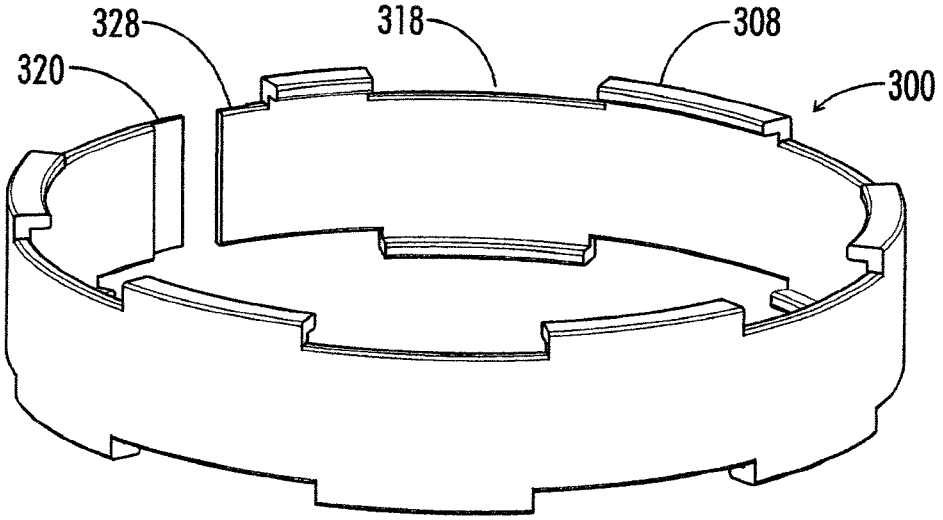
FIG. 15 is another angle of an isometric view of the outer ring.
Figure 16:
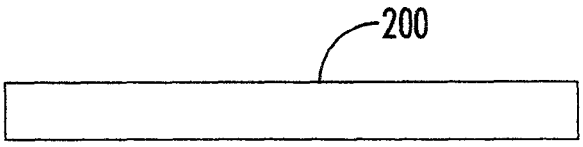
FIG. 16 is a top view of the inner ring.
Figures 17, 18, 19:
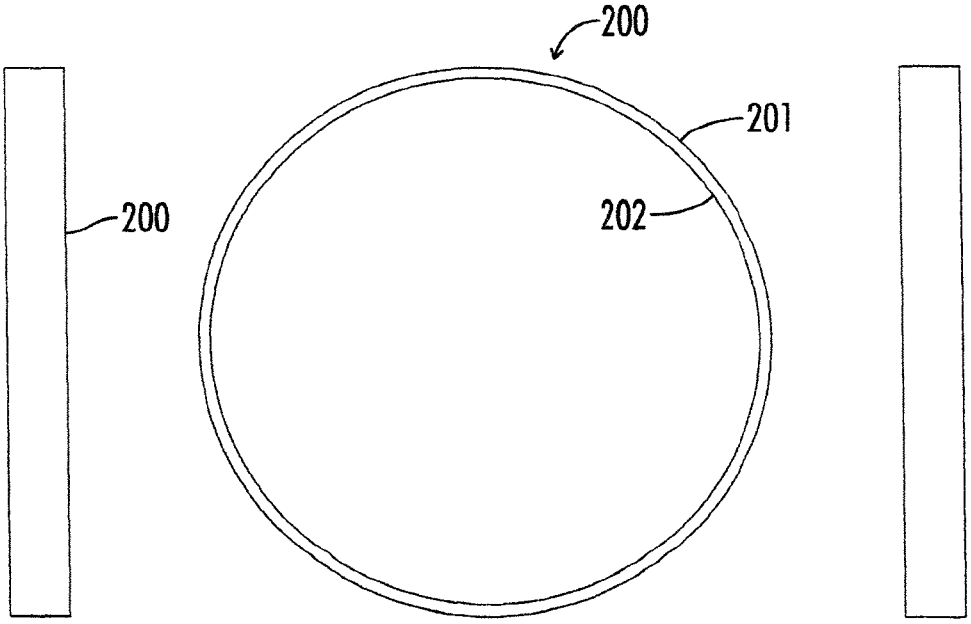
FIG. 17 is a left side view of the inner ring.
FIG. 18 is a front view of the inner ring, the back view being the same.
FIG. 19 is a right side view of the inner ring.
Figure 20:
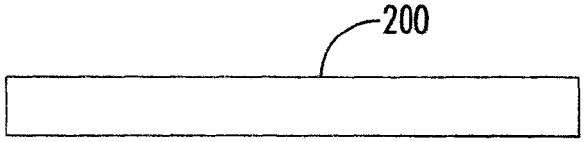
FIG. 20 is a bottom view of the inner ring.
Figure 21:
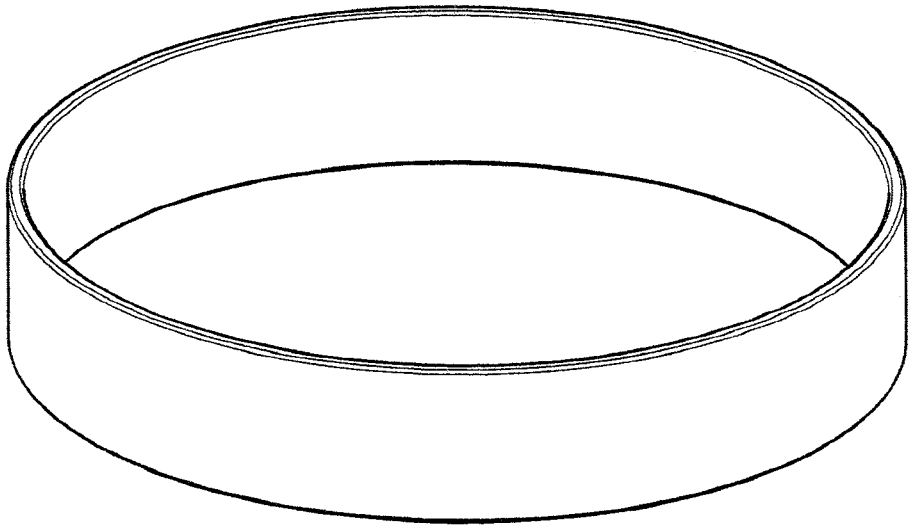
FIG. 21 is an isometric view of the inner ring.

As best seen in FIGS. 6 and 7, the first tubing end 20 is passed through the inner surface 202 of the inner ring 200 to form a first pipe through section 500. The first tubing 20 is then folded back upon itself to form a first pipe rise deflection section 502 and then passes back over the ring clamping surface 201 to form a first pipe center span section 504, first pipe drop deflection section 506, and first pipe overage section 508. The second tubing end 30 is positioned over the installed first tubing end 20 to form a right pipe rise deflection section 510, a right pipe center span section 512, a right pipe drop deflection section 514, and a right pipe overage section 516. As can be noted by FIGS. 6 and 7, the inner ring and outer ring provide a wide clamping surface to seal and frictionally engage the tubing 10 and hold it in position with additional force provided by the capturing segments 308. The extending arm 310 allows for a flexing pressure to be absorbed and applied to the catch finger 312. The ring material for the outer ring 300 should be selected to allow for this flexible pressure to be applied to the catch finger 312 and the finger depth 314 should be selected to provide the requisite force based on the thickness of the tubing 10 to secure the tubing 10 in place without tearing the tubing 10.

Figure 22:
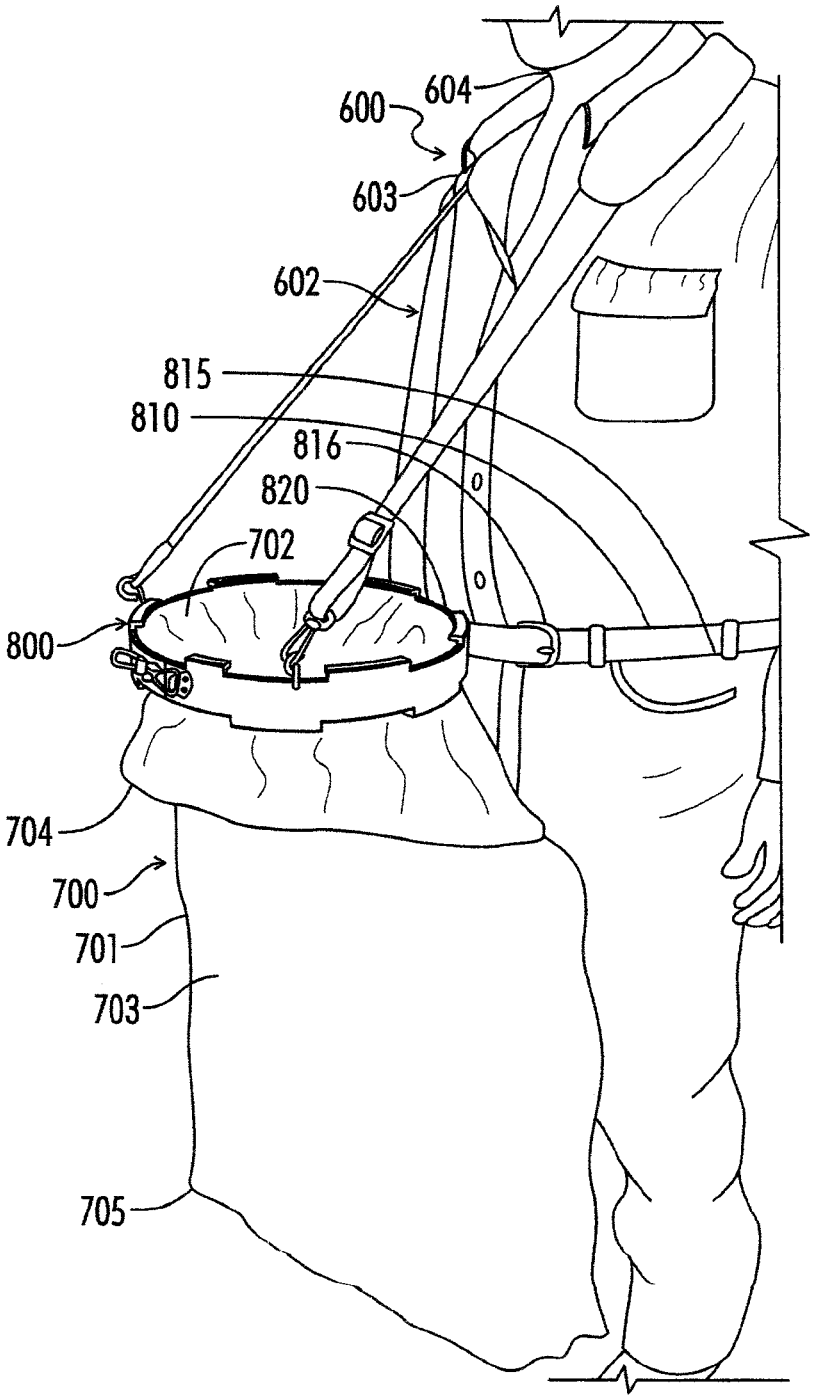
FIG. 22 is a perspective view of the ring used as a bag holder.
Figure 23:
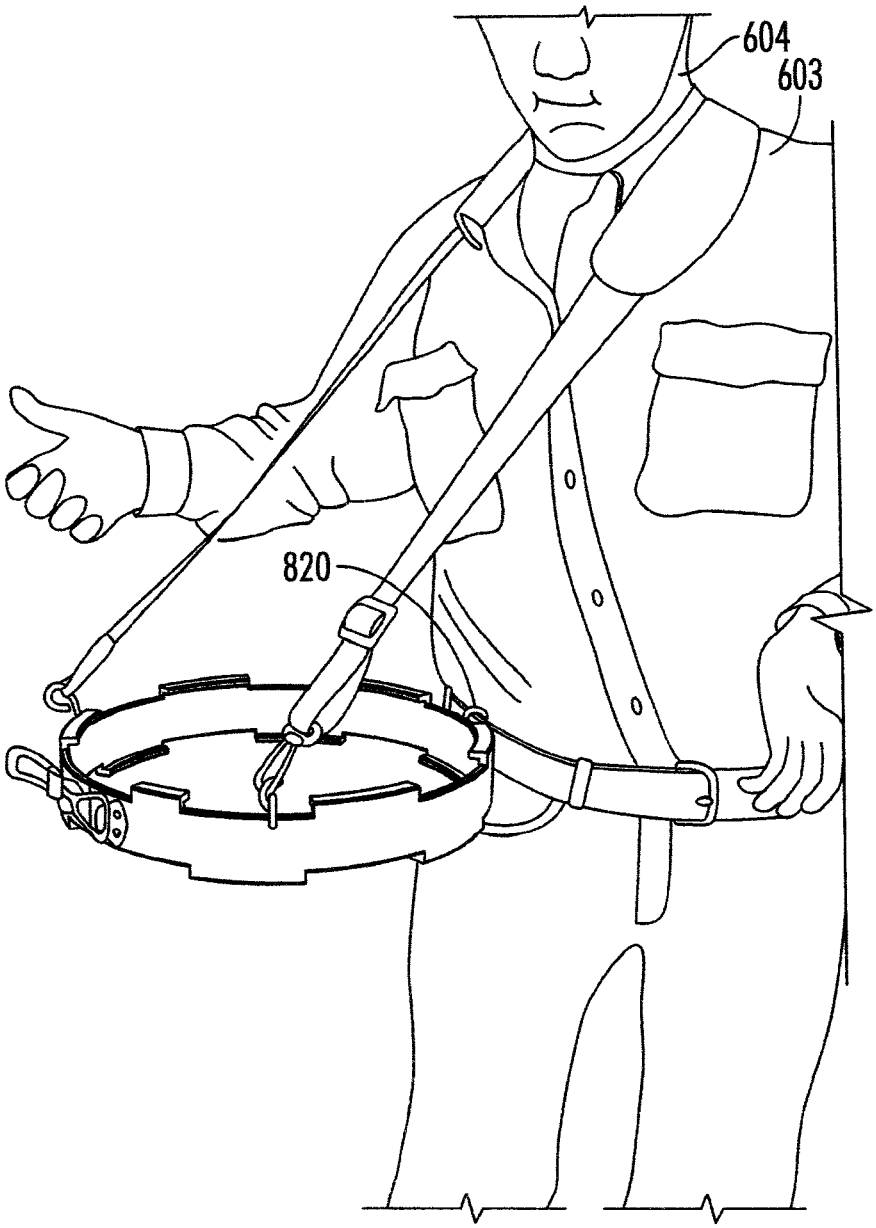
FIG. 23 is a perspective view showing the suspended ring without a bag.
Figure 24:
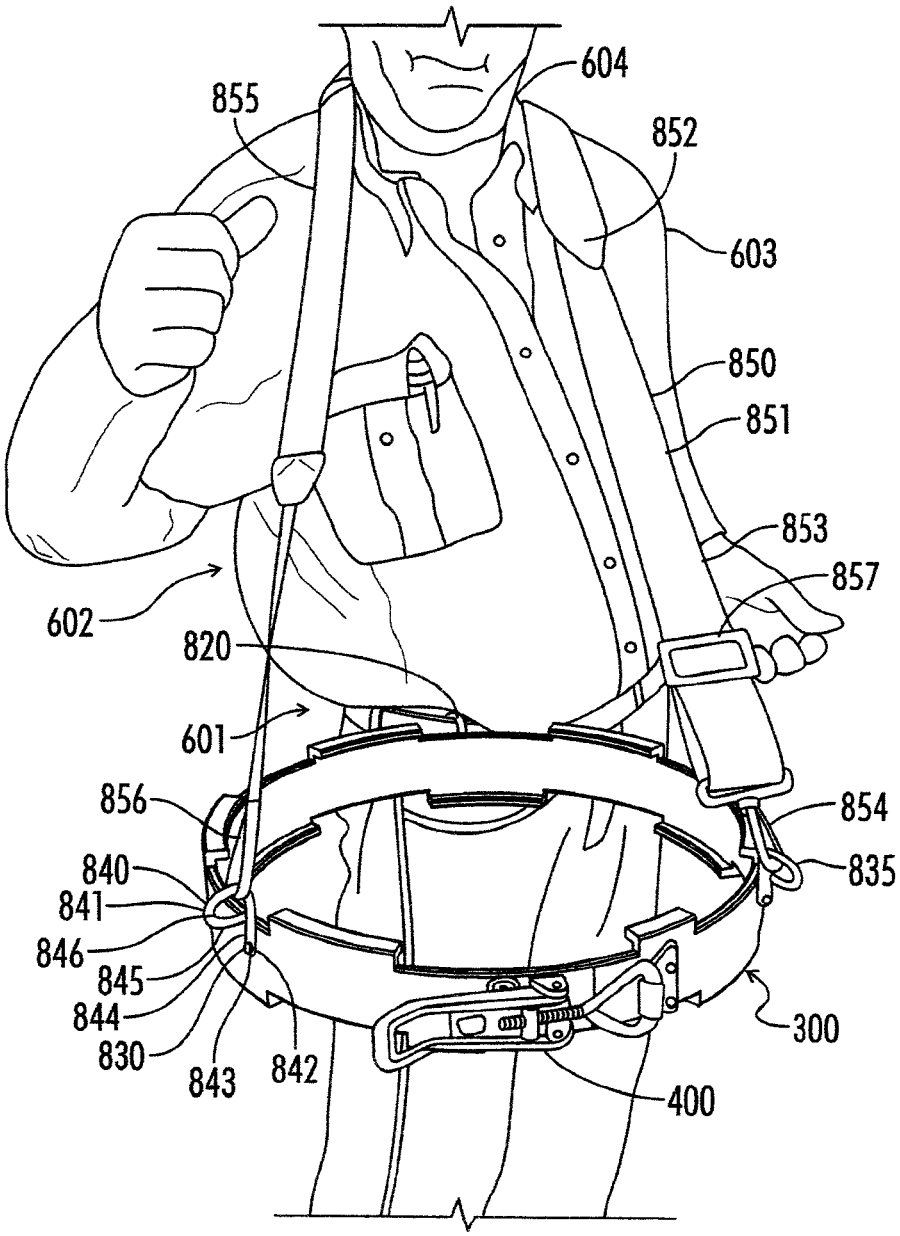
FIG. 24 is an alternative perspective view of the suspended ring.
Figure 25:
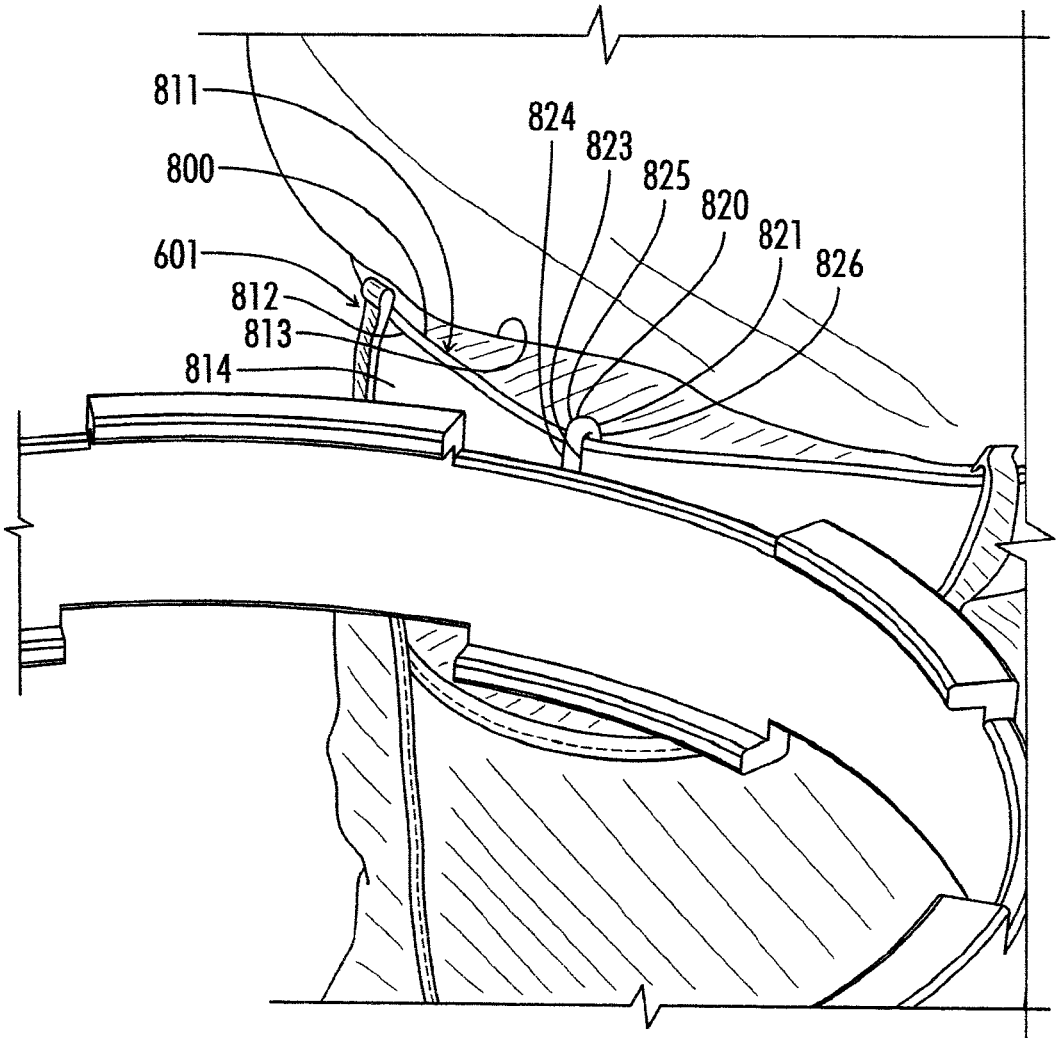
FIG. 25 is a magnified view of the ring to belt connection.
Figure 26:
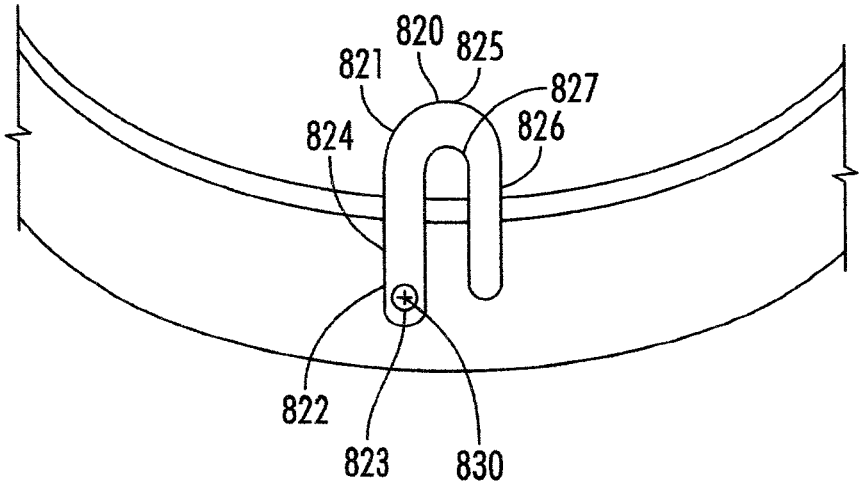
FIG. 26 is a magnified view of the belt hook connection.

FIGS. 22 through 26 show a second embodiment of the invention showing the flexible plastic tube quick clamp 100 used in a bag holder 800. The bag holder 800 is shown mounted on a user 600. The user 600 has a waist 601, torso 602, shoulder 603, and neck 604. The bag holder is shown in FIG. 22 with a mounted bag 700. The bag 700 has a bag wall 701 with an inside wall surface 702 and outside wall surface 703 extending from an open tube end 704 to the closed end 705. The bag 700 is mounted by passing it from below the inner ring 200 through the center and then wrapped back over the ring clamping surface 201 where it is clamped by the outer ring 300.

In this embodiment, the bag holder 800 is mounted using a belt 810 and a neck strap 850 connected at approximately equally spaced intervals around the periphery of the outer ring 300. The belt 810 connection is oriented proximate the user's waist, and the neck strap 820 connects distally to supported the other distally extending edge of the ring 300.

The belt 810 has an elongated belt body 811 with a body top 812, body inside edge 813, body outside edge 814, and body bottom 815. The elongated belt body 811 is secured with a belt buckle 816.

The bag holder 800 is supported off of the belt using a body side belt connection 820 having a u shaped body 821. The U shaped body 821 has a lower clamp end 822 defining a connection aperture 823 that is secured to the outer ring 200 with a connection bolt 830. The U shaped body then extends upward with a rising neck 824 to an outwardly extending top arm 825 that crosses over the body top 812 to a downwardly extending hand 826 thereby forming a belt slot 827. While the current embodiment shows a wire type belt clip a flat belt clip is also envisioned similar to what is commonly described as a money clip.

The outer edge of the bag holder 800 is supported by a distal left strap connector 835 and a distal right strap connector 840. These loops 835, 840 and the connection 820 are equidistant spaced around the perimeter of the outer ring 200. The loops 835, 840 are constructed the same with a p shaped body 841. The p shaped body 841 has a lower clamp end 842 defining a connection aperture 843 that is used to connect to the outer ring 200 using a connection bolt 830. Extending upward from the lower clamp end 842 is a rising neck 844 connected to an outwardly projecting top loop 845 defining a connecting aperture 846.

The neck strap 850 is made with an elongated body 851 including a cushioned pad 852 and both a left strap arm 853 and right strap arm 853. The left strap arm ends in a left connection snap 854 that removably snaps to connect to the connecting aperture 846 of the distal left strap connector 835. The right strap arm 855 is shown using a right connection loop end 856 that slides onto the distal right strap connector 840. The strap 850 can also include an adjustment buckle 857.

Reference numerals used throughout the detailed description and the drawings correspond to the following elements:

Poly lay flat flexible irrigation tubing 10
Pipe inner surface 12
Non-structural collapsing pipe wall 14
Pipe outer surface 16
First tubing end 20
Second tubing end 30
Flexible plastic tube quick clamp 100
Inner shape ring 200
Inner surface 202
Ring clamping surface 201
Left Folding edge 204
Right folding edge 206
Folding radius 208
Outside clamping surface 210
Outer split ring 300
Inside clamping surface 302
Left Capturing edge 304
Right capturing edge 306
Capturing segment 308
Extending arm 310
Extending distance 311
Catch finger 312
Finger depth 314
Finger tip 315
Tip radius 316
Spacing segment 318
Adjustable joint 320
First ring end 322
First clamping surface 324
First sliding overlap finger 326
Ring gap 327
Right ring end 328
Right clamping surface 330
Right sliding overlap finger 332
Overcenter clamp 400
Handle riser 402
Handle pivot 404
Layflat pipe clamp handle 406
Arm pivot 408
Extending catch arm 410
Length adjuster 412
Catch riser 414
Catch slot 416
First pipe through section 500
First pipe rise deflection section 502
First pipe center span section 504
First pipe drop deflection section 506
First pipe overage section 508
Second pipe rise deflection section 510
Second pipe center span section 512
Second pipe drop deflection section 514
Second pipe overage section 516
User 600
Waist 601
Torso 602
Shoulder 603
Neck 604
Bag 700
Bag wall 701
Inside wall surface 702
Outside wall surface 703
Open tube end 704
closed end 705
bag holder 800
Belt 810
Elongated belt body 811
Body top 812
Body inside edge 813
Body outside edge 814
Body bottom 815
Belt buckle 816
body side belt connection 820
U shaped body 821
lower clamp end 822
connection aperture 823
rising neck 824
outwardly extending top arm 825
downwardly extending hand 826
belt slot 827
connection bolt 830
distal left strap connector 835 distal right strap connector 840
P shaped body 841
lower clamp end 842
connection aperture 843
rising neck 844
outwardly projecting top loop 845
connecting aperture 846
Neck strap 850
Elongated body 851
Cushioned pad 852
Left strap arm 853
Left connection snap 854
Right strap arm 855
Right connection loop end 856
Adjustment buckle 857

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A flexible plastic bag clamp apparatus comprising:

an open ended bag with a first wall surface and second wall surface;

a single inner shape ring including a flat inner surface, a first folding edge, a second folding edge, and a flangeless flat outer clamping surface contacting the first wall surface;

the first folding edge and second folding edge each defining a folding radius extending from the flat inner surface to the flat outer clamping surface;

an outer split ring including a first ring end and a second ring end defining a ring gap, and an inside clamping surface contacting the second wall surface;

the outer split ring further including a first capturing edge and a second capturing edge, each capturing edge including a plurality of catch fingers separated by a plurality of spacing segments;

an overcenter clamp connected to the first ring end and the second ring end across the ring gap;

at least one distal strap connector connected to the outer split ring; and a single body side belt connection connected to the outer split ring, the single body side connection including a u shaped body with a lower clamp end defining a connection aperture secured to the outer split ring, the u shaped body including a rising neck, outwardly extending top arm, and downwardly extending hand forming an open belt slot aperture;

the first capturing edge including the plurality of catch fingers including a first catch finger and the plurality of spacing segments including a first spacing segment; and the second capturing edge including a second catch finger opposite the first spacing segment on the first capturing edge.

2. The apparatus of claim 1, the at least one distal strap connector comprising:

a p shaped body connected to the outer split ring.

3. The apparatus of claim 2, the p shaped body comprising:

a rising neck connected to an outwardly projecting top loop defining a connecting aperture.

* * * * *